US008499804B2

(12) United States Patent
Schulte

(10) Patent No.: US 8,499,804 B2
(45) Date of Patent: Aug. 6, 2013

(54) CABLE LOCK BAG

(76) Inventor: Sarah Schulte, Chicago, IL (US)

( * ) Notice: Subject to any disclaimer, the term of this patent is extended or adjusted under 35 U.S.C. 154(b) by 648 days.

(21) Appl. No.: 12/718,493

(22) Filed: Mar. 5, 2010

(65) Prior Publication Data

US 2011/0214787 A1 Sep. 8, 2011

(51) Int. Cl.
*B65D 85/00* (2006.01)
*A45C 13/18* (2006.01)

(52) U.S. Cl.
USPC ..... 150/102; 150/110; 150/107; 150/130; 150/128; 70/67; 70/68; 190/127; 383/107; 383/119

(58) Field of Classification Search
USPC ..... 105/102, 110, 107, 130; 70/68, 70/67; 190/900, 903, 127; 150/102, 110, 150/107, 130, 128; 383/107, 119
See application file for complete search history.

(56) References Cited

U.S. PATENT DOCUMENTS

| | | | | |
|---|---|---|---|---|
| 277,812 | A * | 5/1883 | Vehring | 150/130 |
| 287,680 | A * | 10/1883 | Jenks | 150/110 |
| 1,624,612 | A * | 4/1927 | McCabe et al. | 150/120 |
| 1,999,424 | A * | 4/1935 | Seitz | 190/119 |
| 4,066,195 | A | 1/1978 | Dickler | |
| 4,213,314 | A | 7/1980 | Trader | |
| 5,140,833 | A | 8/1992 | Whalen | |
| 5,762,169 | A | 6/1998 | Deliman et al. | |
| 6,092,401 | A * | 7/2000 | Sankey et al. | 70/18 |
| 6,726,071 | B2 | 4/2004 | Baseflug et al. | |
| 7,277,013 | B2 | 10/2007 | Yen | |
| 7,322,476 | B2 | 1/2008 | Witherspoon | |
| 7,621,160 | B2 * | 11/2009 | Thomson et al. | 70/68 |
| 7,743,713 | B2 * | 6/2010 | Volk et al. | 105/102 |
| 2006/0016531 | A1 | 1/2006 | Volk et al. | |
| 2007/0240798 | A1 | 10/2007 | Bihler | |
| 2008/0128058 | A1 | 6/2008 | Bodine | |
| 2009/0090142 | A1 | 4/2009 | Thomson et al. | |

* cited by examiner

*Primary Examiner* — Tri Mai
(74) *Attorney, Agent, or Firm* — Leydig, Voit & Mayer, Ltd.

(57) ABSTRACT

A bag includes a body portion defining a pouch having an open end and a strengthening rib. A strap of the bag has a first end connected to the body portion adjacent a first side of the open end, and a locking mechanism is connected to the body portion adjacent a second side of the open end. The locking mechanism is arranged to releasably engage a second end of the strap such that the bag can be connected to immovable objects to prevent theft of the bag. Further, a closing mechanism is disposed on the body portion and arranged to close the open end. The closing mechanism has a moveable head that is arranged to engage the second end of the strap when the strap is engaged with the locking mechanism, such that unauthorized access to the contents of the open end is prevented when the bag is locked.

7 Claims, 5 Drawing Sheets

CABLE LOCK BAG

FIELD OF THE INVENTION

The present disclosure relates to bags or satchels, such as those carried by persons and, more particularly, to bags or satchels having anti-theft locking devices incorporated therewith.

BACKGROUND OF THE INVENTION

Personal fashion accessories, such as purses and bags, are typically used to carry valuable items, such as wallets, cellular phones, and a multitude of other types of items. Due to the value of certain such items, purses are often the target of theft, which can occur when the owner of the purse is momentarily distracted or leaves the purse unattended, even for a very short period.

Various types of security features have been proposed in the past to help deter the loss of personal property to theft, but none has addressed the issue of maintaining the security of the contents of a purse without sacrificing the purse's utility or styling. One example of a safety oriented design for a purse can be seen in U.S. Patent Application Publication No. US 2009/0090142, which is titled "Locking Bag with Locking Handle" (the '142 application). The device described in the '142 application includes a lock housing that is disposed within a pouch of a bag and arranged to separately lock a zipper head of the bag as well as one end of a carrying strap of the bag. Although the bag described in the various embodiments of the '142 patent might effectively deter the theft of the contents of the bag, the locking mechanism disposed within the bag detracts from the useful capacity of the pouch and increases the overall weight of the bag. Moreover, the separate locking capability of both the zipper head of the bag as well as the strap of the bag makes its use more complicated.

Another example of a proposed bag having security features can be seen in U.S. Pat. No. 4,231,314 (the '314 patent). The '314 patent discloses a handbag having a locking device in which one end of the carry strap has a lock bolt thereon which inserts into a lock attached to the handbag adjacent one end of the handbag's access opening. A ring connected to the slide of a slide fastener of the bag is arranged to pass around a portion of the strap and thus prevent the opening of the bag when the strap is secured to the lock. However, the handbag disclosed in the '314 patent is prone to theft by cutting the strap of the handbag because it lacks adequate reinforcement.

BRIEF SUMMARY OF THE INVENTION

The invention provides a bag having a cable-style lock incorporated within its design to provide improved anti-theft function for both the bag and, separately, its contents. The cable-style lock extends around the entire periphery of the bag and is hidden from view to improve the bag's appearance without making its security features obvious and without detracting from the useful capacity of the bag or increasing the bag's weight.

In one embodiment, the bag includes a body portion defining a pouch having an open end and a strengthening rib. A strap of the bag has a first end connected to the body portion adjacent a first side of the open end, and a locking mechanism is connected to the body portion adjacent a second side of the open end. The locking mechanism is arranged to releasably engage a second end of the strap such that the bag can be connected to immovable objects to prevent theft of the bag. Further, a closing mechanism is disposed on the body portion and arranged to close the open end. The closing mechanism has a moveable head that is arranged to engage the second end of the strap when the strap is engaged with the locking mechanism, such that unauthorized access to the contents of the open end is prevented when the bag is locked.

DETAILED DESCRIPTION OF THE INVENTION

Figure 1:
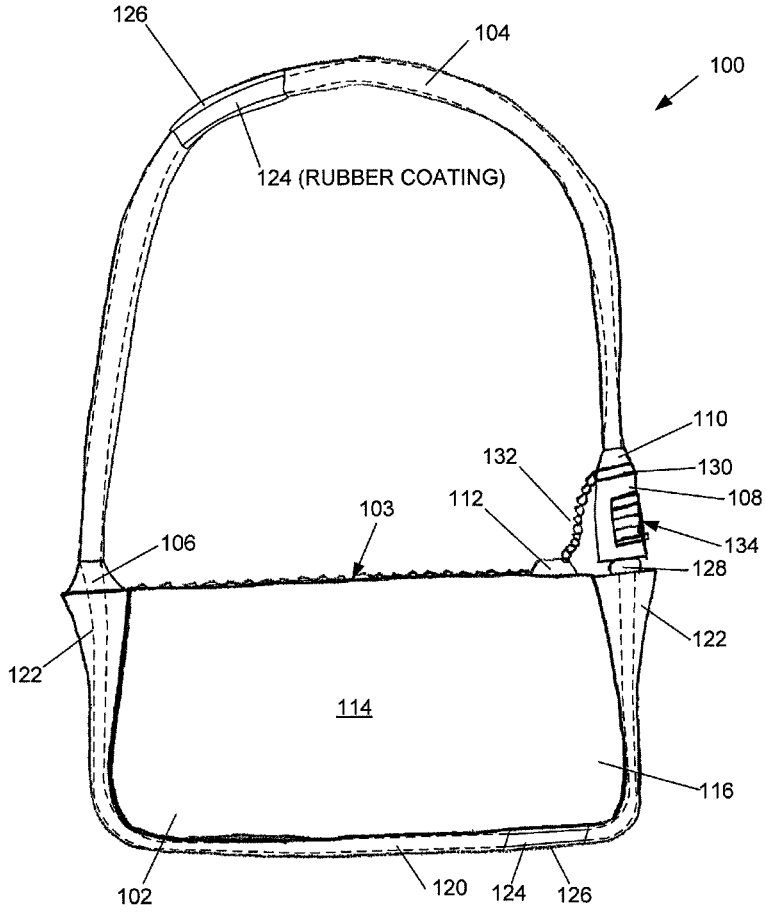
FIG. 1 is a side view of a purse shown in its locked condition in accordance with the disclosure.

A side view of a first embodiment for a bag 100 is shown in FIG. 1. It is contemplated that various aesthetic features of the bag 100 may be designed or adjusted to suit the countless aesthetic attributes of the bag 100, such as the shape, size, design, or fabric used to cover the bag. Thus, the bag 100 as well as the other embodiments presented herein are shown using generic shapes for those bags that are sufficient to illustrate the security aspects of those structures, but the generic representations of these bags should not be construed as limiting to the type or style of bag in which they are applicable.

With reference to the bag 100 shown in FIG. 1, the bag 100 includes a body portion 102 having an open end 103, and a strap 104. The strap 104 is permanently connected to the body portion 102 on one end 106 thereof, and is connected to the body portion 102 by a lock 108 at its second end 110. A re-closeable linear fastener, such as a zipper 112, extends along the open end 103 of the body portion 102 of the bag 100 and is generally disposed between the first and second ends 106 and 110 of the strap 104.

Figure 3:
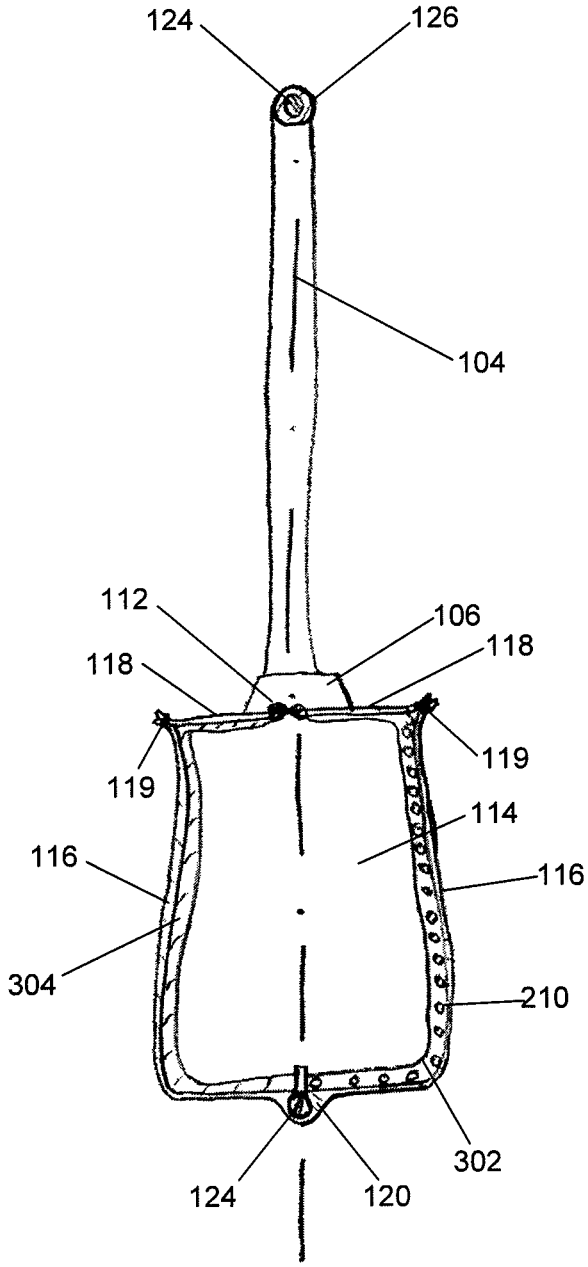
FIG. 3 is a cross section of the two embodiments of the purses shown in FIGS. 1 and 2.

In the embodiment shown in FIG. 1, the body portion 102 of the bag 100 defines a pouch 114, which is accessible through the open end 103. In further reference to FIG. 3, the pouch 114 is an enclosed space or pocket of the bag 100 that can be used to carry various items (not shown). The pouch 114 is defined by two side walls 116 that are connected with two top walls 118 by stitching 119 (FIG. 3). The two top walls 118 are engageable to one another along the length of the open end 103 by the zipper 112.

The body portion 102 of the bag 100 further includes a strengthening rib 120 extending between two anchors 122 around the outer periphery of the pouch 114. In the illustrated embodiment, a cable 124 extends continuously around the bag 100 within the strap 104 and the strengthening rib 120. The cable 124 may be a braided steel cable having a rubberized coating deposited thereon (not shown), and be enclosed by at least one layer of covering material 126, such as fabric or leather.

In the illustrated embodiments, the cable 124 has two free ends, one of which is permanently connected to the lock 108 via, for example, a flexible linkage 128. Thus, the cable 124 extends around the bag 100 by being connected to the lock 108, passing around the pouch 114 by extending uninterrupted through the strengthening rib 120, continuing through the anchor 122 that is connected to the first end 106 of the strap 104, through the strap 104, and terminating to the second end 110 of the strap 104 where, as described below relative to FIG. 2, it is releasably connected to the lock 108. The second end 110 of the strap 104 may include features to capture a ring 130 that is connected via a connecting member 132 to the head of the zipper 112 when the cable 124 is in its locked condition within the lock 108. It is noted that although the lock 108 is shown as a combination-style lock having rotating wheels 134 to set an opening combination that releases the cable 124 from therein, any other type of lock capable of providing this function is contemplated.

Figure 2:
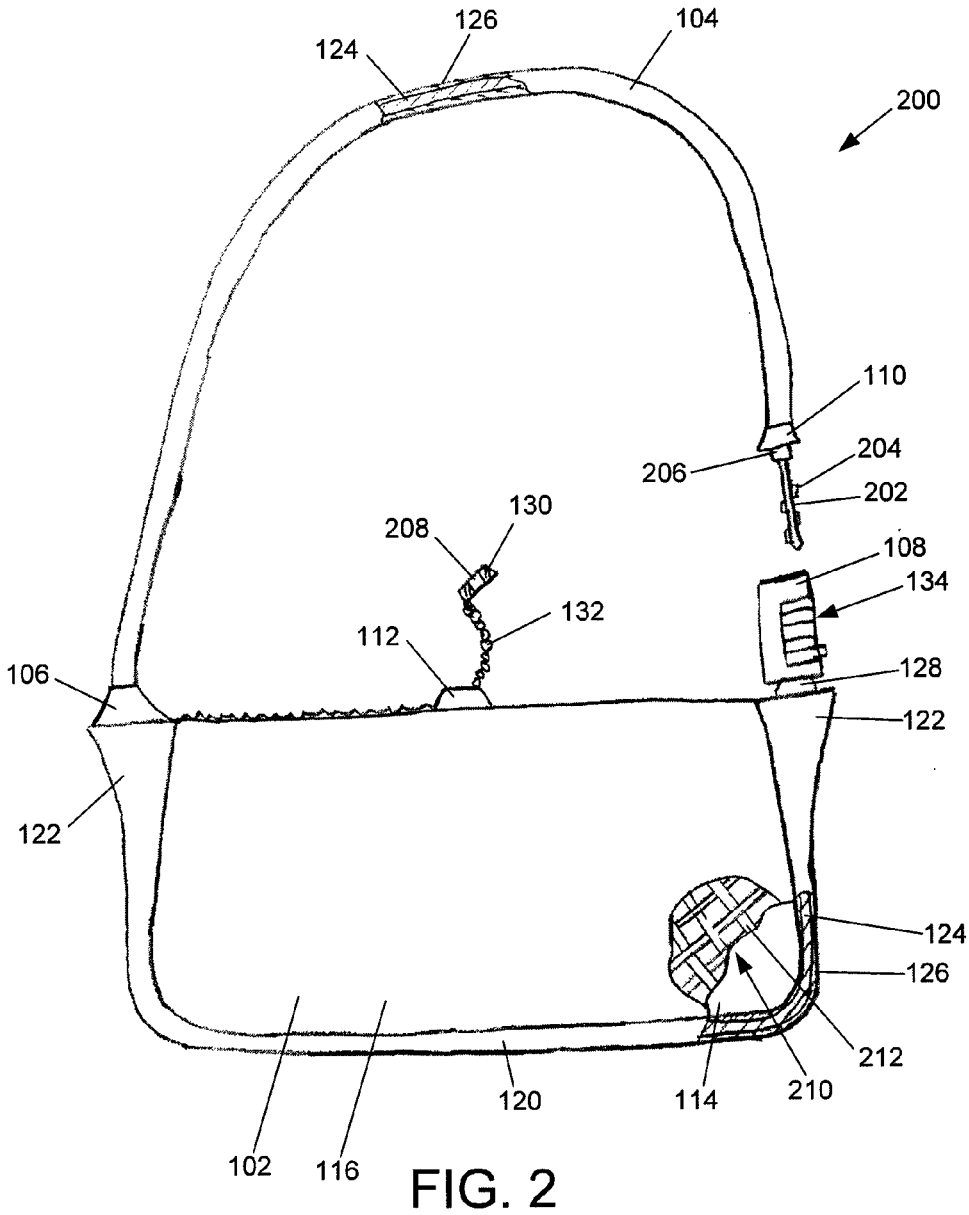
FIG. 2 is a side view of an alternative embodiment of the purse of FIG. 1 shown in an unlocked condition.

A partial cross section of a bag 200 having optional, additional security features relative to the bag 100 shown in FIG. 1 is shown in FIG. 2. It is noted that features and structures of the bag 200 that are the same or similar to corresponding features and structures of the bag 100 already described relative to FIG. 1 are denoted with the same reference numerals in FIG. 2 for simplicity. In the illustration of FIG. 2, the bag 200 is shown in an unlocked condition, with the second end 110 of the strap 104 having been released and removed from the lock 108. In this condition, a locking shaft 202 extending from the second end 110 of the strap 104 can be seen. The locking shaft 202 is integrally formed on the end of the cable 124 and is arranged to engage locking elements of the lock 108.

More specifically, the illustrated lock 108 includes a shaft opening (not shown) extending through the locking wheels 134. One or more locking teeth 204 are formed externally on the locking shaft 202. When the locking wheels 134 are set to the correct combination or positions, the shaft opening permits the unhindered motion of the locking shaft 202 and the locking teeth 204 therein. However, the locking teeth 204 engage features of the locking wheels 134 when the locking wheels 134 are not set to the correct combination while the locking shaft 202 is within the lock 108, thus preventing the removal of locking shaft 202 from therewithin and locking the second end 110 of the strap 104 to the body portion 102 of the bag 100.

The illustrated embodiment further includes a neck portion 206 defined along a segment of the locking shaft 202. As can be seen, the ring 130 that is connected to the head of the zipper 112 forms an opening 208. When the user of the bag 200 or 100 wishes to prevent the bag from opening to reveal its contents, the user may insert the ring 130 around the locking shaft 202 such that the opening 208 is disposed around the neck portion 206, before inserting the locking shaft 202 into the lock 108.

The illustration of FIG. 2 further includes an optional anti-intrusion layer 210 that is disposed as a lining around the pouch 114. As illustrated in FIG. 2, the anti-intrusion layer 210 includes a mesh of wires 212 that are interwoven and provide resistance of the side walls 116 of the pouch 114 to cutting or ripping while the bag 200 is in its locked condition. Alternative types of anti-intrusion material layers may be used, such as rubberized or silicon coated fiber meshes, fine steel meshes and screens, and so forth.

A cross section of two alternative embodiments, which are shown side by side, is presented in FIG. 3. In this figure, elements already described are denoted by the same reference numerals as previously used for simplicity and for better understanding of the disclosed structures. As shown on the right side of FIG. 3, each side panel 116 of the bag, for example, the bag 200 (FIG. 2) may enclose an anti-intrusion layer 210 on an outer side. The anti-intrusion layer 210 may be covered along an inner portion thereof by a layer of lining 302, that protects the contents of the pouch 114 from scratching or other damage by contact with the mesh. An alternative embodiment is shown on the left side of FIG. 3. In this embodiment, the anti-intrusion layer 210 and lining 302 are integrated into an anti-intrusion liner 304 that separates the side wall 116 from the internal cavity of the pouch 114. The anti-intrusion liner 304 has a greater thickness and resilience than the simple lining 302, and may be made of a composite material that resists cutting and tearing, such as rubberized fiber materials, Tyvek®, and others.

Figure 4:
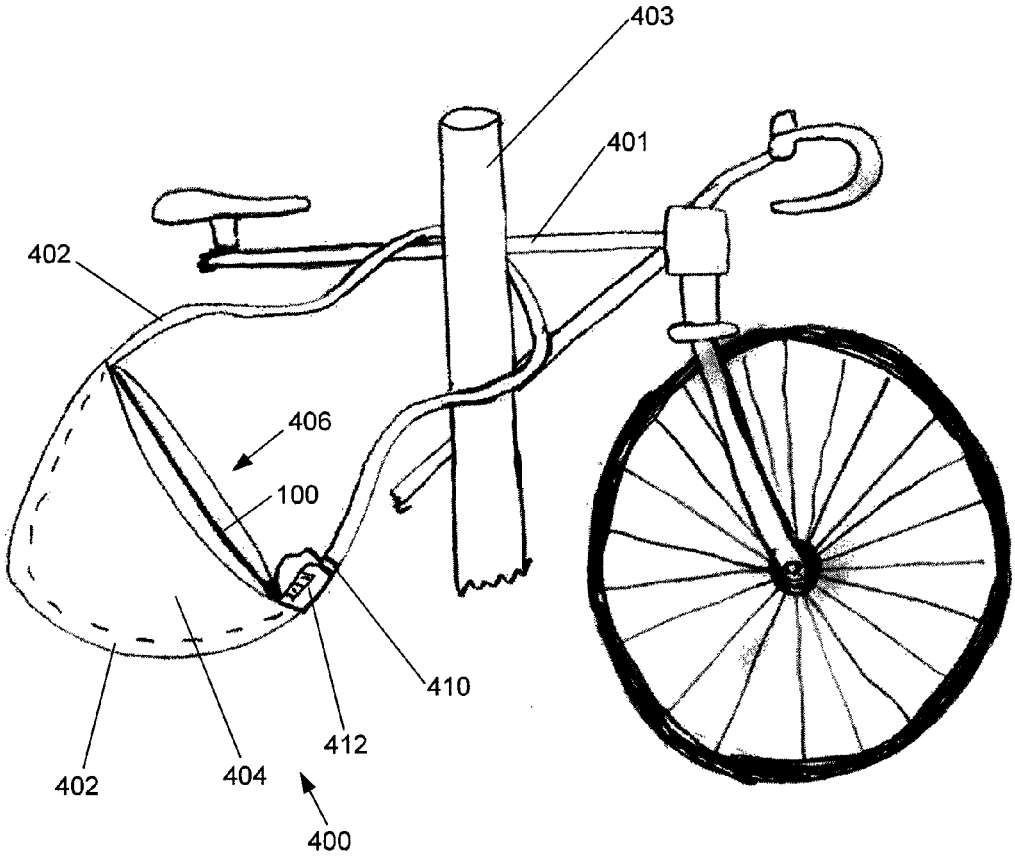
FIG. 4 is an outline view of a locking satchel in accordance with the disclosure.

Although the embodiments described and shown thus far relate to a purse-type article incorporating the security features described herein, other applications are possible. One such application is shown in FIG. 4. FIG. 4 illustrates a locking satchel 400 during use as a lock for a bicycle 401. The locking satchel 400 embodies many of the security features described thus far. Thus, the locking satchel 400 includes a cable 402 that forms a severable loop that can be used to secure moveable objects, such as the bicycle 401, to stationary objects, such as a pole 403, or any other such type of use, as is known.

The locking satchel 400 further includes a pouch portion 404 that has an open end 406. A zipper 408 can be used to close the open end 406 of the pouch portion 404. The head of the zipper 408 can be secured to the cable 402 in a similar fashion as described above relative to the other embodiments, by engagement of a ring 410 within a portion of the cable at a lock 412 that secures the cable 402 into the loop-shape.

Figure 5:
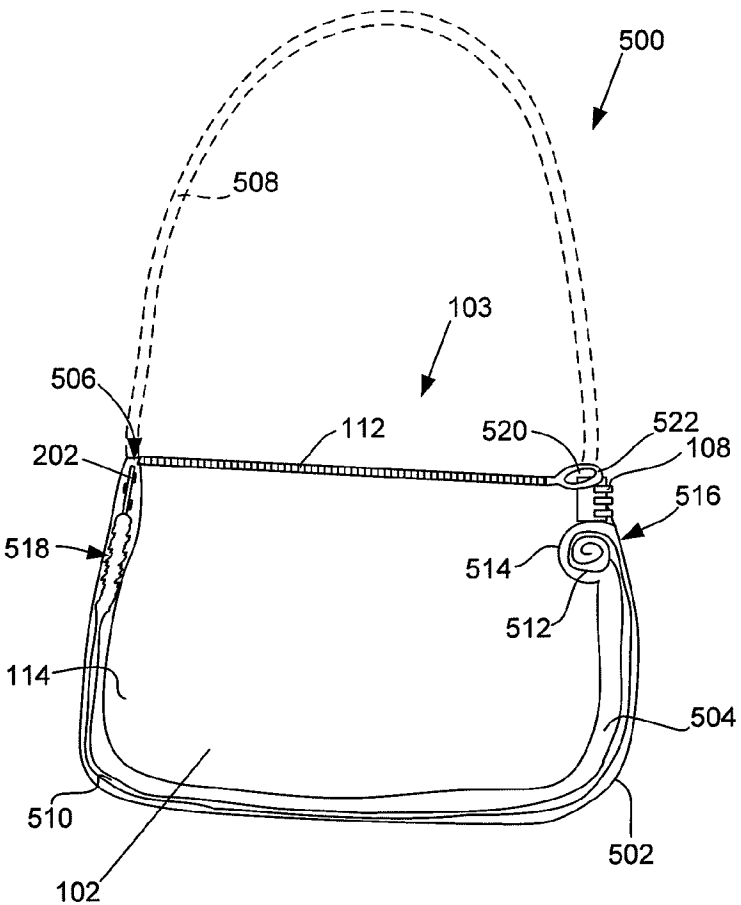

A side view in cross section of an alternate embodiment for a bag 500 is shown in FIG. 5. In the description that follows, elements or features that are the same or similar as elements or features previously shown and described relative to other embodiments are denoted by the same reference numerals for simplicity. Thus, similar to the bags 100 and 200 previously described, the bag 500 includes a body portion 102 having an open end 103 that is closeable by a zipper 112. The body portion 102 of the bag 500 includes an outer layer 502 that encloses the pouch 114. The outer layer 502 may be made of a stiff material, such as leather, that is arranged to provide structural shape to the bag 500 and that further provides resistance to punctures and cuts, as previously described. A tunnel 504, which is a essentially a passageway defined around an outer periphery of the body portion 102, is disposed in the body portion 102 between the outer layer 502 and the pouch 114. In the illustrated embodiment, the tunnel 504 is blind at one end and open at its opposite end through an opening 506 defined in the body portion 102.

Figure 6:
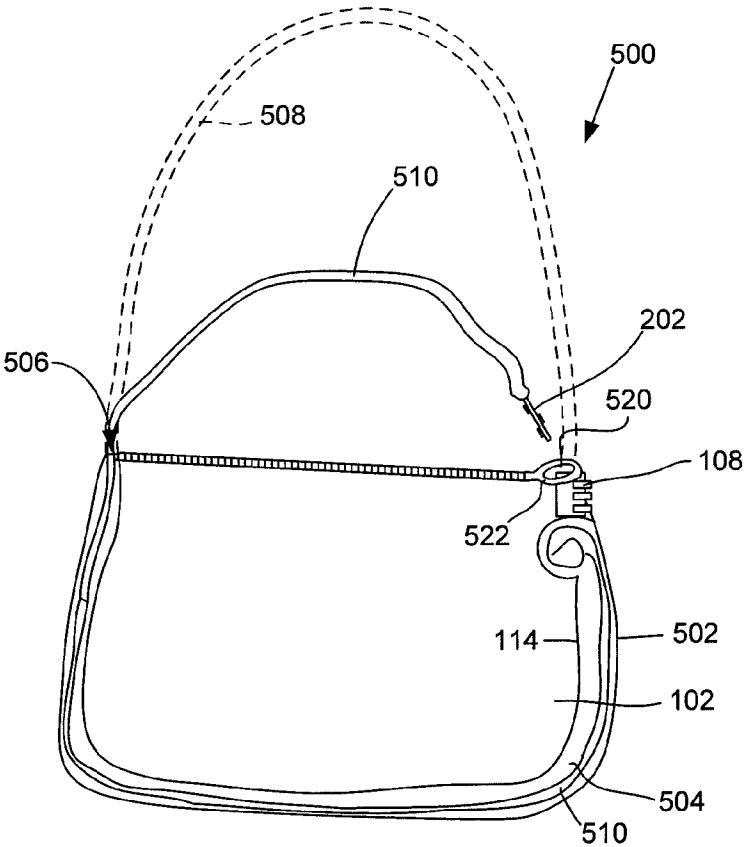
FIGS. 5 and 6 are side views of an alternate embodiment of a purse having a retractable strap in accordance with the disclosure.

In many respects, the features of the bag 500 that are intended to prevent or discourage intrusion and/or theft are similar to those described above and shown in the preceding figures relative to the bags 100 and 200. However, although the bag 500 may include an optional strap 508, which is shown in dashed line, it further includes a retractable strap 510. The retractable strap 510 is disposed within the tunnel 504 and is arranged to retract within the body portion 102 when not used, as shown in FIG. 5, or extend from the body portion 102 through the opening 506 when in use, as shown in FIG. 6.

There are numerous ways retraction and/or storage of portions of the strap 510 within the body portion 102 may be accomplished. In the embodiment illustrated in FIGS. 5 and 6, the bag 500 includes a reel 512 that is enclosed within a housing 514 disposed within the body portion 102. The reel 512, which may be spring loaded, is one example of a cable retraction mechanism 516, but other known cable retraction mechanisms may be used. When the retractable strap 510 is in a retracted position, a portion of the strap 510 may be wound around the reel 512 for storage. Moreover, the retractable strap 512 may be made of a stiff material, such as steel, and include a fabric covering layer 518 that covers the exposed portions of the strap 510 when extended from the opening 506.

When use of the retractable strap 510 is desired to secure the bag 500 and its contents, the user may simply pull the end of the strap 510 out of the opening 506 thus extending it relative to the body portion 102 of the bag 500. The free end of the strap 510 includes a locking shaft 202 having locking teeth 204 that engage a lock 108 as was described above. The length of the strap 510 that extends externally to the body portion 102 in this operating condition may remain in its extended state or may alternatively be subject to a retraction force depending on the particular configuration of the retraction mechanism 516. In its extended position, the retractable strap 510 may be used to secure the bag 500 to an immovable or otherwise anchoring object as was discussed above. Thus, the portion of the retractable strap 510 that is disposed within the tunnel 504 essentially forms a strengthening rib that surrounds a portion of the bag 500 as was previously described relative to the bag 100.

When securing the contents of the bag 500 in addition to or instead of securing the bag 500, the free end of the retractable strap 510 may pass through an opening 520 formed in the pull tab 522 of the zipper 112. In this arrangement, which can be used interchangeably with the corresponding arrangements previously described and shown relative to the bags 100 and 200, the free end of the retractable strap 510 may be engaged to the lock 108 after passing through the opening 520. In this way, opening of the zipper 112 to provide access to the contents of the bag 500 through the open end 103 of the body portion 102 can be avoided as long as the free end of the strap 510 is engaged with the lock 108.

It is worth mentioning that besides its use as a securing device, the retractable strap 510 may also serve as a carrying strap for the bag 500, especially if the permanent strap 508 is not present. In this arrangement, the free end of the retractable strap 510 may be secured to the lock 108 when the strap 510 is in a selectively extended position to provide a mode of carrying the bag 500. Further, although the bag 500 is shown without an anti-intrusion layer 210, as shown, for example, in the embodiment for the bag 100, such additional safety features can be incorporated with the bag 500.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A bag, comprising:

a body portion defining a pouch having an open end and a strengthening rib extending around a closed end of the body portion;

a strap having a first end associated with the body portion adjacent a first side of the open end;

a locking mechanism connected to the body portion adjacent a second side of the open end, the locking mechanism arranged to releasably engage a second end of the strap;

a closing mechanism disposed on the body portion and arranged to close the open end, the closing mechanism having a moveable head that is associated therewith that is arranged to engage the second end of the strap when the same is engaged with the locking mechanism such that opening of the open end is prevented;

a strengthening rib having a hollow elongate shape that forms a tunnel extending therethrough, the strengthening rib extending between the first and second sides of the open end around the body portion; and a cable extending uninterrupted from the second end of the strap, then along an entire length of the strap, then through the first end of the strap and into the body portion, then within the tunnel formed in the strengthening rib, and then being connected to the locking mechanism.

2. The bag of claim 1, further comprising:

two side panels disposed on the body portion and defining therebetween the pouch;

two liners disposed, disposed on the body portion between the two side panels; and two anti-intrusion layers of material disposed, one each, between each of the two side panels and each of the two liners.

3. The bag of claim 2, wherein each of the two anti-intrusion layers is made of a composite material that resists cutting and tearing.

4. The bag of claim 1, wherein the second end of the strap defines a locking shaft that is integrally formed therewith and that has locking features arranged to engage locking elements of the locking mechanism.

5. The bag of claim 1 , wherein the cable is a braided steel cable having a rubberized coating disposed thereon.

6. The bag of claim 1, wherein the locking mechanism is a combination lock.

7. The bag of claim 1, wherein the closing mechanism is a zipper having a sliding head, and wherein a locking ring is connected to the sliding head and arranged to be disposed around a portion of the strap when the strap is engaged with the locking mechanism.

* * * * *